United States Patent [19]

Godyak

[11] Patent Number: 5,019,750

[45] Date of Patent: May 28, 1991

[54] RADIO-FREQUENCY DRIVEN DISPLAY

[75] Inventor: Valery A. Godyak, North Andover, Mass.

[73] Assignee: GTE Products Corporation, Danvers, Mass.

[21] Appl. No.: 466,104

[22] Filed: Jan. 16, 1990

[51] Int. Cl.[5] ..... H05B 41/16

[52] U.S. Cl. ..... 315/248; 315/344; 362/367

[58] Field of Search ..... 315/248, 39, 324, 169.4, 315/267, 344; 362/367, 184

[56] References Cited

U.S. PATENT DOCUMENTS

| | | | |
|---|---|---|---|
| 2,566,280 | 8/1951 | Yandt | 362/184 |
| 3,500,118 | 3/1970 | Anderson . | |
| 3,579,015 | 5/1971 | Gregory | 315/169.4 |
| 3,629,638 | 12/1971 | Veron | 315/169.4 |
| 3,997,816 | 12/1976 | Haugsjaa et al. . | |
| 4,095,142 | 6/1978 | Murayama | 315/248 |
| 4,427,920 | 1/1984 | Proud | 315/248 |
| 4,427,921 | 1/1984 | Proud et al. . | |
| 4,559,480 | 12/1985 | Nobs . | |
| 4,647,821 | 3/1987 | Lapatovich et al. . | |
| 4,649,322 | 3/1987 | Tellan et al. . | |
| 4,665,341 | 5/1987 | Imamura et al. . | |

*Primary Examiner*—Eugene R. LaRoche
*Assistant Examiner*—A. Zarabian
*Attorney, Agent, or Firm*—Carlo S. Bessone

[57] ABSTRACT

A video display for use in conveying information as, for example, in a sports stadium. The video display includes a plurality of electrodeless lamps mounted in a metallic housing which is defined by a back wall and a front wall. The front wall is provided with a plurality of holes formed therein and is spaced from the back wall by means of side walls. An electrodeless lamp is located within each of the holes in the front wall and is surrounded by a cylindrical wall formed in the front wall. One end of each lamp is in proximity to a conductive plate which is formed to provide an equipotential surface to the lamps. Radio-frequency (RF) energy of from 10 to 100 megahertz is coupled from an external RF power supply to the housing. A strong electric field produced between the portion of the conductive plate in proximity to one end of a lamp and the cylindrical surface surrounding the lamp is sufficient to cause breakdown and excitation of the electrodeless lamp fill material. For controlling the operation of individual lamps, a semiconductor switch is series connected between the conductive plate and each of the lamps.

9 Claims, 2 Drawing Sheets

RADIO-FREQUENCY DRIVEN DISPLAY

CROSS-REFERENCE TO A RELATED APPLICATION

This application discloses, but does not claim, inventions which are claimed in copending U.S. Ser. No. 292,786 filed Jan. 3, 1989 and assigned to GTE Laboratories, Incorporated.

FIELD OF THE INVENTION

This invention relates in general to large scale video displays of information, data, images and the like, and pertains, more particularly, to such displays having an array of electrodeless lamps arranged as pixels.

BACKGROUND OF THE INVENTION

Application for such lamp arrays include display boards for advertising and instant replay of information in sports stadiums One type of such array includes the use of a large number of fluorescent lamps which are arranged in groups of three or more to form pixels Each pixel contains a light source for each of the primary colors, i.e., blue, red and green. The selective excitation of each pixel in an array of many thousand pixels can provide images similar to television images to observers located at some distance The relative excitation of the primary color sources within each pixel determines the color which the observer perceives as emanating from that pixel, and, in the aggregate, the color information necessary to perceive entire images in color. Each lamp is coated with a primary color phosphor to emit blue, red or green light.

In the prior art, each lamp contains at least one cathode chosen from the conventional art of fluorescent lamp making. The cathode is suitably impregnated with low work function material, and is a copious source of emitted electrons when raised to some elevated temperature The lamps also contain a noble gas, e.g., argon, at a low pressure (typically, a few torr) and a small quantity of mercury. Electrons are emitted by the cathode and are accelerated by a voltage applied between the cathode and an anode. Some of the electrons undergo collisions which result in the excitation of mercury atoms, which then emit ultraviolet light at 254 nanometers. This radiation is converted by the phosphor to produce colored light. The anode serves as a collector of the charge flowing in the fluorescent tube and is the electrode which supplies voltage which controls the quantity of electron current, the intensity of the 254 nanometer emission, and therefore, the brightness of the light emitted by the individual pixel element.

Examples of fluorescent lamps or lamp arrays suitable for use in video displays are found in U.S. Pat. Nos 4,559,480 (Nobs); 4,649,322 (Tellan et al) and 4,665,341 (Imamura et al). Each lamp or lamp array taught in these patents contain at least a pair of electrodes.

One difficulty in using such fluorescent lamps relates to the deleterious effect of the cathode emissive material, which is gradually evaporated at the required elevated temperature and is subsequently deposited on the walls of the phosphor coated lamp. This is one of several mechanisms which gradually diminish the light output of the lamp and is one which is particularly troublesome in lamps of very small dimension. In the large scale display application this gradual dimming is troublesome because of the degradation of image quality, particularly where it may occur on time scales of a few hundred hours. Any imbalance in the aging process can produce uneven image brightness or color and lamp replacements may stand out as exceedingly bright pixels.

Another potential problem area in conventional fluorescent lamp technology is the glass to metal seals employed. While this is a well established technology and can be accomplished with a great deal of reliability, the use of as many as one hundred thousand lamps in a single display places unusually rigid demands on reliability of these seals as well as the electrode structures which they support.

It is clear that there is a need for a display which uses lamps having improved reliability and which are extremely slow to deteriorate.

The individual lamps commonly used are typically operated at power levels near 1 watt. Accordingly, each lamp must be individually supplied with power of this amount totalling as much as 10 to 100 kilowatts for a typical large display. Depending on the requirements of the individual lamps for cathode heating or pre-heating, additional wiring may be required. Power circuitry is costly and complex making construction and repair difficult. A need, therefore, also exists for reduction in the cost and complexity of the wiring and socketing of the light emitting pixel.

SUMMARY OF THE INVENTION

It is, therefore, an object of the present invention to obviate the disadvantages of the prior art.

It is still another object of the invention to provide a video display which has high reliability and long operating life.

It is another object of the invention to provide a video display which is energy efficient and which may be constructed at low cost.

These objects are accomplished in one aspect of the invention by the provision of a video display including a metallic housing defined by a back wall and a front wall. The front wall is spaced from the back wall by side walls. The front wall defines therein a plurality of holes each surrounded by an adjacent cylindrical surface formed in the front wall. The video display further includes a plurality of electrodeless lamps. Each of the lamps is disposed within a respective hole in the front wall RF means provides RF energy to the housing. Coupling means within the housing couples RF energy from the RF means to the electrodeless lamps. The coupling means includes the cylindrical surface surrounding each of the lamps.

In accordance with further teachings of the present invention, the coupling means includes conductive plate means disposed within and isolated from the housing walls. The conductive plate means is coupled to the RF means so as to provide an equipotential reference to facilitate equal lamp energizing. Preferably, each of the lamps has an end in proximity to the conductive plate means.

In accordance with further aspects of the present invention, the video display further includes switch means (e.g., a semiconductor switch) coupled between the conductive plate means and each of the lamps for providing individual lamp control.

In accordance with still further teachings of the present invention, the coupling means includes impedance matching means coupled between the RF means and the lamps for matching the impedance of the video display to the RF means. In a preferred embodiment, the impedance matching means includes a tank circuit consisting of a capacitor and an inductive transformer. Preferably, the capacitor is variable.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
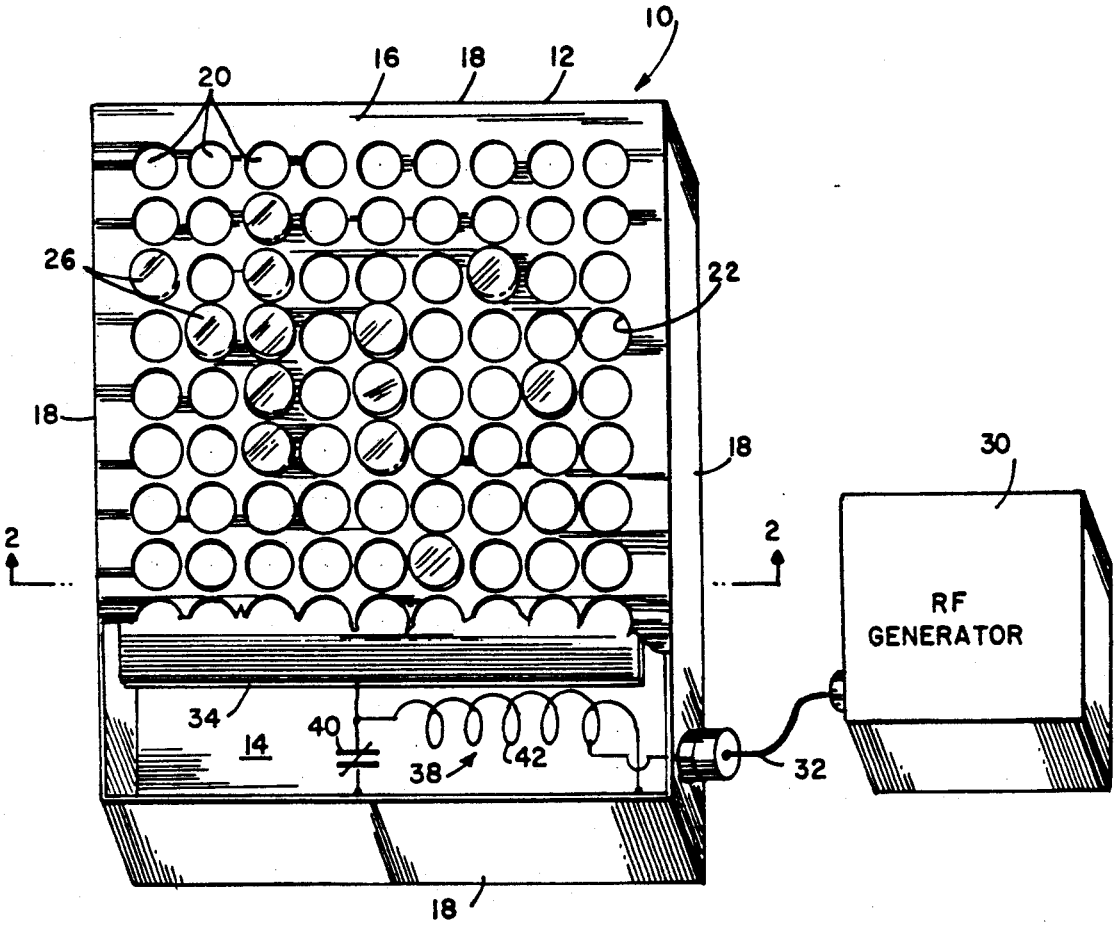
FIG. 1 represents a front elevational view, partially broken away, of a video display according to the present invention.

Referring to the drawings with greater particularity, FIG. 1 illustrates a front elevational view of a preferred embodiment of a radio-frequency (RF) driven video display 10 which includes a plurality of electrodeless lamps 26. Video display 10 includes a box-shaped housing 12 defined by a back wall 14 and a front wall 16. Front wall 16 is spaced from back wall 14 by four side walls 18. The front, back and side walls may be made of a metal, such as aluminum.

Figure 2:
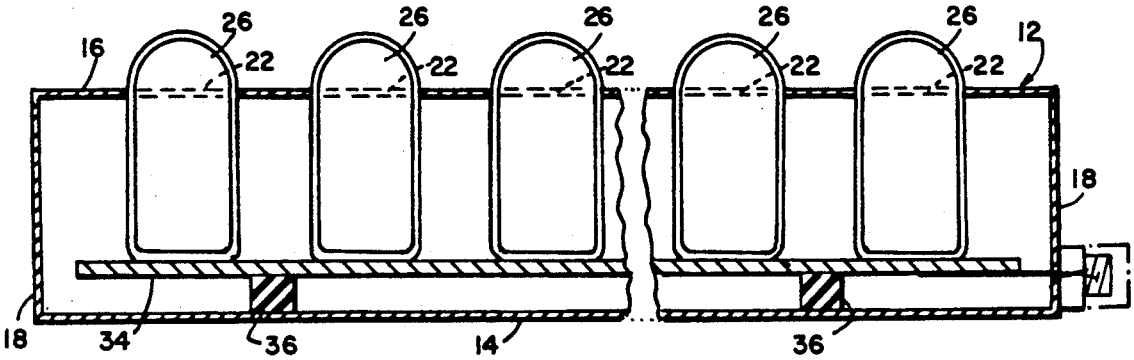
FIG. 2 is a cross sectional side view of one embodiment of the video display.
Figure 3:
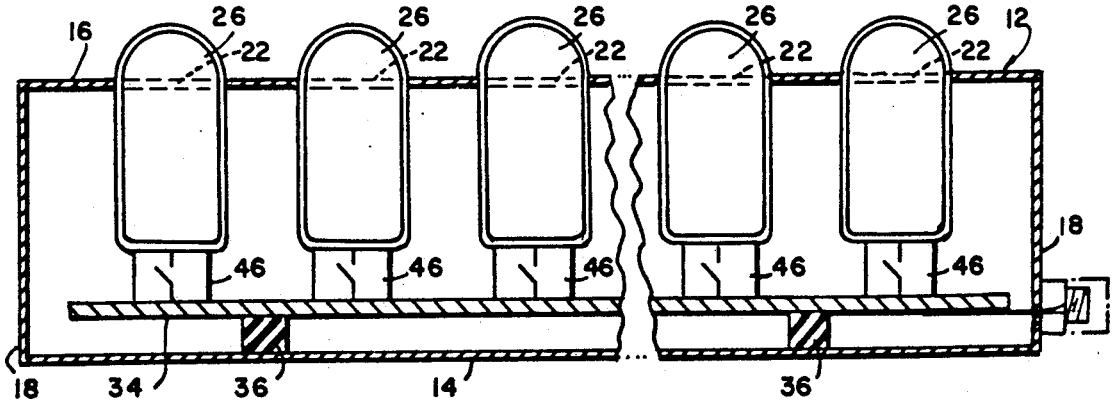
FIG. 3 is a cross sectional side view of another embodiment of the video display.

Front wall 16 contains a plurality of holes 20 formed therein. Each of the holes 20 is surrounded or defined by an adjacent cylindrical surface 22 formed in front wall 16. A conductive plate 34, electrically connected to an external RF generator 30, is preferably disposed within housing 12. The purpose of surface 22 and conductive plate 34 will be discussed later. Disposed within each of the holes 20 in front wall 16 and in proximity to a corresponding cylindrical surface 22 is an electrodeless lamp 26. As best shown in FIGS. 2 and 3, conductive plate 34 is positioned within proximity to one end of each of the lamps. The diameter of each hole is chosen slightly larger than the diameter of a respective lamp. The longitudinal axis of each lamp is arranged perpendicular to front wall 16.

For illustrational purposes, only a limited number of holes in the front wall is shown containing a lamp. In practice, all holes will contain an electrodeless lamp. Also, only a limited number (i.e., 81 in a 9 by 9 matrix) of holes or lamps is shown in FIG. 1. In actual practice, the display may contain many thousands of holes, with each one containing a lamp.

A RF generator 30 provides RF energy to the interior of housing 12 through a 50 ohm connecting coaxial cable 32. The frequency of the power delivered to the housing is preferably from 10 to 100 megahertz.

Also illustrated in FIG. 1 is an impedance matching circuit which includes a tank circuit 38 consisting of a capacitor 40 and an inductive transformer 42 connected between RF generator 30 and lamps 26. One end of capacitor 40 is connected to conductive plate 34 while the other end thereof is connected to one of the side walls 18. One end of transformer 42 is connected to the junction of capacitor 40 and conductive plate 34. The other end of transformer 42 is connected to one of the side walls 18. A tap winding on transformer 42 is connected by wire to the center contact of a conventional wall-mounted cable connector. The wire connecting the tap winding is electrically isolated from the side wall through which it extends. The external shell of the wall-mounted cable connector and the entire housing is electrically connected to ground. A suitable connector (shown in phanthom in FIGS. 2 and 3), which is connected to coaxial cable 32 (FIG. 1), mates with the wall-mounted connector.

Tank circuit 38 matches the impedance of the RF generator to the impedance of the video display. Preferably, capacitor 40 is variable so that tank circuit 38 can be tuned on a desirable resonant frequency. One suitable frequency is 40.68 megahertz.

Each electrodeless lamp 26 is formed from a tubular envelope containing a fill material composed of a noble gas at low pressure and a quantity of mercury. Either the entire interior surface of the envelope or only that portion which extends external to the housing is coated with a suitable phosphor. Excitation of the fill material by a discharge within the envelope produces ultraviolet light which excites the phosphor coating to emit visible light at spectral regions governed by the composition of the phosphor.

The RF energy provided by the RF generator 30 is capacitively coupled within housing 12 to each of the electrodeless lamps. The means for coupling the RF energy to the lamps includes the above mentioned cylindrical surface 22 in front wall 16 which surrounds each of the lamps together with conductive plate 34. As illustrated in FIGS. 2 and 3, conductive plate 34 is electrically isolated from back wall 14 by means of mounting insulators 36. Adequate spacing provides isolation of conductive plate 34 from front wall 16 and side walls 18. Conductive plate 34 provides an equipotential reference surface to RF to facilitate equal lamp energizing provided that its size is much smaller than the wavelength of the corresponding frequency. The conductive plate may be made of, for example, a solid sheet of metal, a metallic mesh screen or an insulative material having a metallized foil disposed thereon, such as, a copper-clad printed circuit board.

In operation, the RF energy produces a strong electric field between the portion of the conductive plate in proximity to one end of a lamp and the cylindrical surface surrounding the lamp. This electric field is sufficient to cause breakdown and excitation of the electrodeless lamp fill material. The low pressure RF discharge produced in the lamp emits ultraviolet radiation which in turn is absorbed by the phosphor coating on the interior wall of the lamp and thereafter converted to visible light.

In the embodiment in FIG. 2, all lamps in the video display are working in parallel As a result, all lamps are illuminated together. Such a display can be used, for example, to display fixed images or text, either in black and white or color. In this regard, the images or text are formed, for example, by lamps having a color different than the color of the remaining lamps which form the background. The displays can easily be changed by merely substituting or rearranging different colored lamps. Alternatively, the display can be used to provide backlighting for a liquid crystal display.

In another embodiment as illustrated in FIG. 3, a semiconductor switch 46 is coupled between conductive plate 34 and each of the lamps 26. The switches can be connected to a central control unit (not shown) which controls the operation of the individual lamps. Such a display, which may be comprised of a large number of pixels, is useful in displaying, for example, moving text or television information. Each pixel is formed from a group of three electrodeless lamps with the grouped lamps of each pixel providing light sources at each of the primary colors, i.e., red, green and blue.

In a typical but non-limitative example of a video display in accordance with the teachings of the present invention, the video display is constructed from a rectangular-shaped cast aluminum box 7.0 inches long, 7.0 inches wide and 2.5 inches deep. The front wall contains 54 holes arranged in a 6 by 9 matrix. Each hole contains an electrodeless lamp. A conductive plate 6.5 inches by 4.7 inches is disposed within the box and is isolated from the back wall by several insulators. The conductive plate is energized by RF power of about 100 volts at 40.68 megahertz. A matching tank circuit is disposed within the aluminum box and consists of an inductive transformer and a variable air capacitor. The transformer is constructed of four turns of 1 inch diameter from ⅛ inch copper tubing. A tap is provide between turns 1 and 2. The capacitor has a maximum capacitance of 25 picofarads. Each lamp is formed from ½ inch diameter tubing and has an overall length of 1¼ inches. A phosphor coating is disposed on the interior surface of each lamp. The lamps are filled with 100 Percent argon at 3.0 torr and a quantity of mercury. The breakdown (i.e., starting) voltage of each lamp is from 75 to 80 volts.

There has thus been shown and described an improved video display. The lamps constructed in accordance with the teachings of the present invention do not possess the many limitations of lamps conventionally used with such displays. For example, burnout of an electrode can never be the cause of a failure of a lamp used in the present invention. Similarly, sputtering of electrode materials upon the surface of the phosphor, causing darkening thereof, is completely eliminated. Moreover, the problem of metal to glass or ceramic seals are completely eliminated. in addition, because of the electrodeless design, the cost and complexity of the wiring and socketing of the lamps is reduced. An added benefit to having a more reliable lamp is the reduced service cost which accompanies lamp replacement. Because the lack of electrodes eliminates end and cathode heating losses, the electrodeless RF lamps are more efficient than the regular fluorescent lamps used in in prior art displays.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A video display comprising:

a metallic housing defined by a back wall and a front wall, said front being spaced from said back wall by side walls, said front wall defining therein a plurality of holes each surrounded by an adjacent cylindrical surface formed in said front wall;

a plurality of electrodeless lamps, each of said lamps disposed within a respective hole in said front wall;

RF means for providing RF energy to said housing; and coupling means within said housing for coupling RF energy from said RF means to said electrodeless lamps, said coupling means including said cylindrical surface surrounding each of said lamps.

2. The video display of claim 1 wherein said coupling means further includes conductive plate means disposed within and isolated from said walls of said housing, said conductive plate means being coupled to said RF means so as to provide an equipotential reference to facilitate equal lamp energizing.

3. The video display of claim 2 wherein each of said lamps has an end in proximity to said conductive plate means.

4. The video display of claim 2 further including insulative means for isolating said conductive plate means from said walls of said housing.

5. The video display of claim 2 further including switch means coupled between said conductive plate means and each of said lamps for providing individual lamp control.

6. The video display of claim 5 wherein said switch means includes a semiconductor switch.

7. The video display of claim 1 wherein said coupling means further includes impedance matching means coupled between said RF means and said lamps for matching the impedance of said video display to said RF means.

8. The video display of claim 7 wherein said impedance matching means includes a tank circuit consisting of a capacitor and an inductive transformer.

9. The video display of claim 8 wherein said capacitor is variable.

* * * * *